US010272320B2

(12) United States Patent
Carter

(10) Patent No.: US 10,272,320 B2
(45) Date of Patent: Apr. 30, 2019

(54) TRUCK ASSEMBLY

(71) Applicant: Daniel Carter, Pooraka (AU)

(72) Inventor: Daniel Carter, Pooraka (AU)

( * ) Notice: Subject to any disclaimer, the term of this patent is extended or adjusted under 35 U.S.C. 154(b) by 0 days.

(21) Appl. No.: 16/077,574

(22) PCT Filed: Feb. 10, 2017

(86) PCT No.: PCT/AU2017/000042
§ 371 (c)(1),
(2) Date: Aug. 13, 2018

(87) PCT Pub. No.: WO2017/136873
PCT Pub. Date: Aug. 17, 2017

(65) Prior Publication Data

US 2019/0038959 A1 Feb. 7, 2019

(30) Foreign Application Priority Data

Feb. 11, 2016 (AU) ..... 2016900460

(51) Int. Cl.
*A63C 17/02* (2006.01)
*A63C 17/00* (2006.01)
*A63C 17/22* (2006.01)
*A63C 17/01* (2006.01)

(52) U.S. Cl.
CPC ..... *A63C 17/0093* (2013.01); *A63C 17/012* (2013.01); *A63C 17/015* (2013.01); *A63C 17/226* (2013.01)

(58) Field of Classification Search
CPC ..... A63C 17/012
USPC ..... 280/11.27, 11.28, 87.042
See application file for complete search history.

(56) References Cited

U.S. PATENT DOCUMENTS 4,213,226 A * 7/1980 Demrick ..... B60B 33/0002 16/36
5,372,383 A * 12/1994 Kubierschky ..... A63C 17/01 280/11.223
5,853,182 A * 12/1998 Finkle ..... A63C 17/01 280/87.042
5,879,013 A * 3/1999 Shih ..... A63C 17/01 280/11.28
6,315,312 B1 * 11/2001 Reyes ..... A63C 17/01 280/11.27
6,367,819 B1 * 4/2002 Andersen ..... A63C 17/0093 280/11.27
6,474,666 B1 * 11/2002 Andersen ..... A63C 17/0093 280/11.28
6,523,837 B2 * 2/2003 Kirkland ..... A63C 17/01 280/11.28
6,648,345 B2 * 11/2003 Lee ..... A63C 17/0093 280/11.27

(Continued)

*Primary Examiner* — Jeffrey J Restifo
(74) *Attorney, Agent, or Firm* — Renner Kenner Greive Bobak Taylor & Weber

(57) ABSTRACT

A truck assembly for roller skates or a skateboard including a base portion configured to be secured to an underside of a roller skate or skate board, an axle housing for receiving an axle, an axle, at least a first and second pins, at least a first bushing, wherein the axle is housed within the axle housing and the first bushing and the axle is captivity held within the axle housing and the at least a first and second pins are in engagement of the at least two pins with the axle.

11 Claims, 4 Drawing Sheets

(56) References Cited

U.S. PATENT DOCUMENTS 6,659,480 B1 * 12/2003 Newman ..... A63C 17/01
188/74
6,793,224 B2 * 9/2004 Stratton ..... A63C 17/01
280/87.041
6,932,362 B1 * 8/2005 Barrett ..... A63C 17/01
280/11.27
7,093,842 B2 * 8/2006 Chmelar ..... A63C 17/0093
280/11.27
7,104,558 B1 * 9/2006 Saldana ..... A63C 17/0093
280/11.27
7,121,566 B2 * 10/2006 McClain ..... A63C 17/0093
280/87.042
7,219,907 B2 * 5/2007 Chang ..... A63C 17/0093
280/11.225
7,413,200 B2 * 8/2008 Horn ..... A63C 17/01
280/11.27
7,871,087 B2 * 1/2011 Knapton ..... A63C 17/0093
280/11.27
7,984,917 B2 * 7/2011 Lake ..... A63C 17/0046
280/11.27
8,328,206 B2 * 12/2012 Williams, Jr. ..... A63C 17/0093
280/11.27
8,684,370 B2 * 4/2014 Baumann ..... A63C 17/0093
280/11.27
8,783,699 B2 * 7/2014 Gesmer ..... A63C 17/012
280/87.042
8,827,285 B1 * 9/2014 Su ..... A63C 17/226
280/11.27
8,998,225 B2 * 4/2015 Magee ..... A63C 17/012
280/87.042
9,010,777 B2 * 4/2015 Braden ..... A63C 17/012
280/11.28
2004/0041360 A1 * 3/2004 Lukoszek ..... A63C 17/0093
280/11.27

* cited by examiner

Substitute Sheet
(Rule 26) RO/AU

TRUCK ASSEMBLY

FIELD OF THE INVENTION

This present invention relates to a truck assembly for use in roller skates or skateboarding.

In particular, the invention relates to a truck assembly for roller skates and or skateboards in which the truck assembly provides increased control and feedback to the operator, particularly when used in high speed applications.

BACKGROUND

The typical truck assembly which has been used for roller skates and skateboards relies on a user changing their centre of mass from one side of the platform (skateboard/roller skate) to the other. This causes the truck to pivot thus changing the direction in which the corresponding wheels attached thereto are pointing. The rider on the skateboard or roller skates thus shifts their weight to one side or another in order to effect a change in the desired direction.

A typical truck for a skateboard or roller skate is shown in FIG. 1 (prior art) in which there is a base plate (10) attached to the underside of a skateboard or roller skate, a hangar (12) having an axle (14) running through it. Located between the base plate (10) and the hangar (12) are bushings (16) and (17) that provide a cushioning mechanism during the turning of the truck. A bolt (20) commonly referred to as a king pin holds the hangar (12) to the base plate (10). By tightening or loosening the king pin nut (22), as well as by adjusting the hardness of the bushings, the trucks may be tuned by the operator to provide the appropriate turning characteristics.

In addition, typical truck assemblies commonly used for roller skates or skateboards do not provide sufficient stability and control in high speed situations, such as those typically encountered in the sport of speed skating as the main control of the trucks is largely dominated by controlling tension of the king pin and/or variation in the elastomer material used in the bushings. The forces exerted by the user in a tight turn, using standard truck assemblies are sufficient at times to overcome the resistance of firmer bushings. Moreover, the standard truck assembly is relatively heavy and whilst this is generally not a problem for the recreational skater, the advanced skaters are interested in pursuing lighter weight truck assemblies so as to lower the overall weight of their skate, as well as assemblies that provide accurate and effective turning properties suitable in high speed applications.

The heavy weight and undesirable turning characteristics of the truck assemblies of present devices is a serious shortcoming and further improvements are seen as being desirable in this area.

OBJECT OF THE INVENTION

It is an object of the present invention to overcome, or at least substantially ameliorate, the disadvantages and shortcomings of the prior art.

Other objects and advantages of the present invention will become apparent from the following description, taking in connection with the accompanying drawings, wherein, by way of illustration and example, an embodiment of the present invention is disclosed.

SUMMARY OF THE INVENTION

According to the present invention, there is provided a truck assembly including a base portion configured to be secured to an underside of a roller skate or skate board, an axle housing for receiving an axle, an axle, at least a first and second pins, at least a first bushing, wherein the axle is housed within the axle housing and the first bushing and the axle is captivity held within the axle housing and the at least a first and second pins are in sliding engagement with the axle.

In preference, the at least a first and second pins pass through at least a first and second opening in an outer surface of the axle housing and abut against the axle.

In preference, the base portion is adapted to be releasably secured to an underside of a roller skate or skateboard.

In preference, the at least a first and second pins are held in place in the axle housing by a first and second retaining ring.

In preference, the at least a first and second retaining rings are distal to one another on the axle housing.

In preference, the at least a first and second retaining rings have a pin receiving groove.

In preference, first and second retaining rings are held in place on the axle housing by a plurality of retaining means.

In preference, the plurality of retaining means are screws.

In preference, there is at least a first bushing and a second bushing located within the axle housing.

In preference, the first bushing and second bushings support the axle within the axle housing.

In preference, the busing is a shrouded busing.

In preference, the first and second retaining rings have a groove about an outer periphery.

In preference, the groove is shaped to receive at least a portion of the pin.

In preference, the pin is a locking pin.

BRIEF DESCRIPTION OF THE DRAWINGS

By way of example only, an embodiment of the invention is described more fully hereafter, with reference to the accompanying drawings, in which.

DETAILED DESCRIPTION OF THE INVENTION

Figure 1:
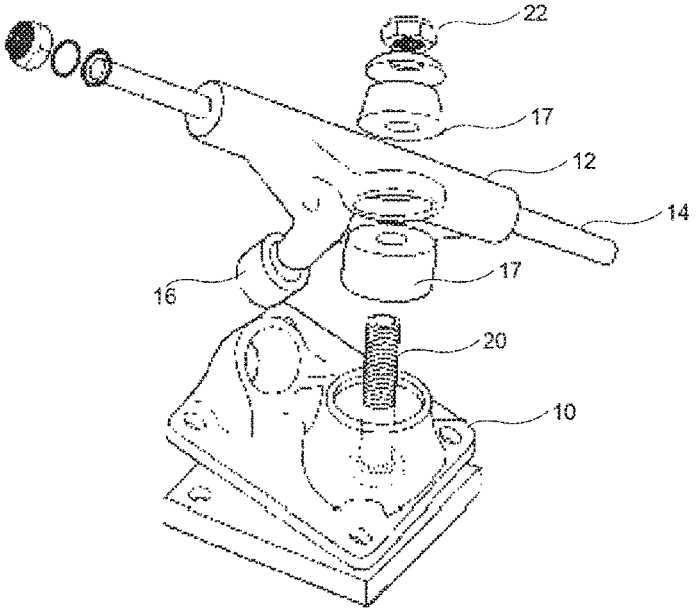
PRIOR ART Figure 1
FIG. 1 is a perspective view of a prior art truck assembly for a skateboard or roller skate.
Figure 2:
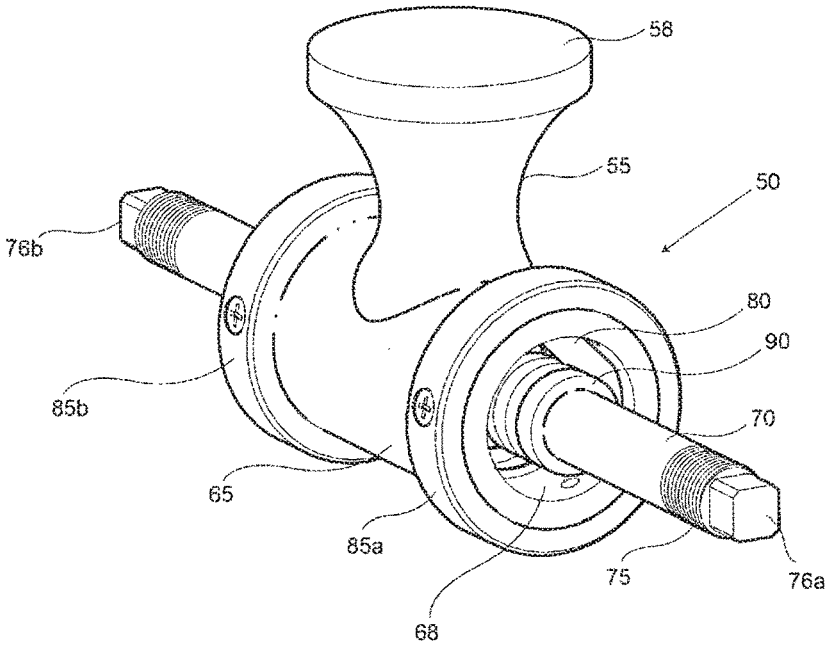
FIG. 2 is a perspective view of the truck assembly of the present invention.
Figure 3:
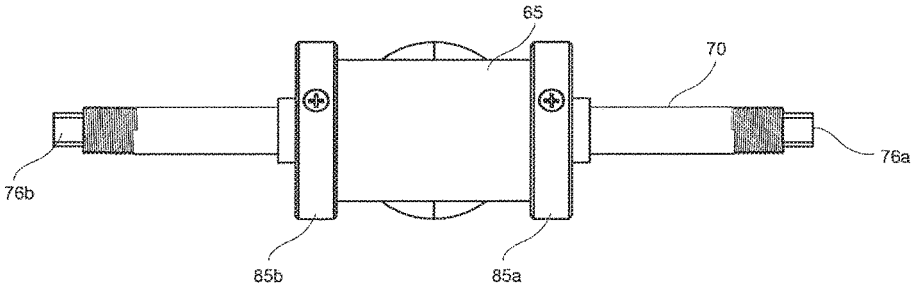
FIG. 3 is an underside view of the present invention.
Figure 4:
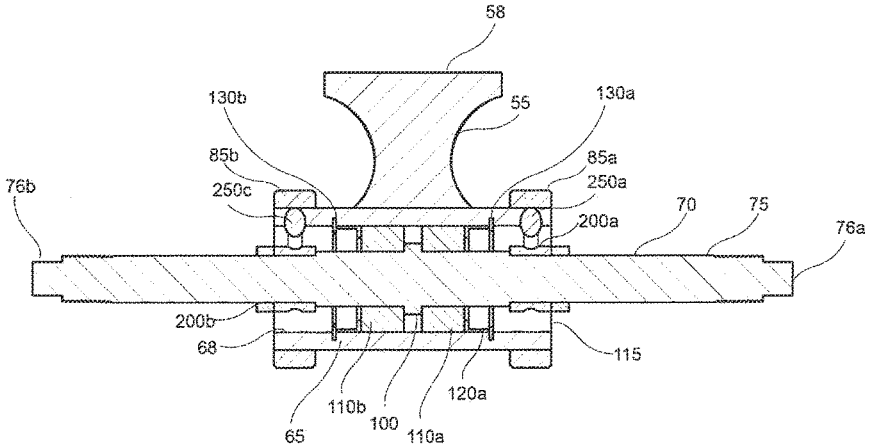
FIG. 4 is a side sectional view through B-B in FIG. 3.
Figure 5:
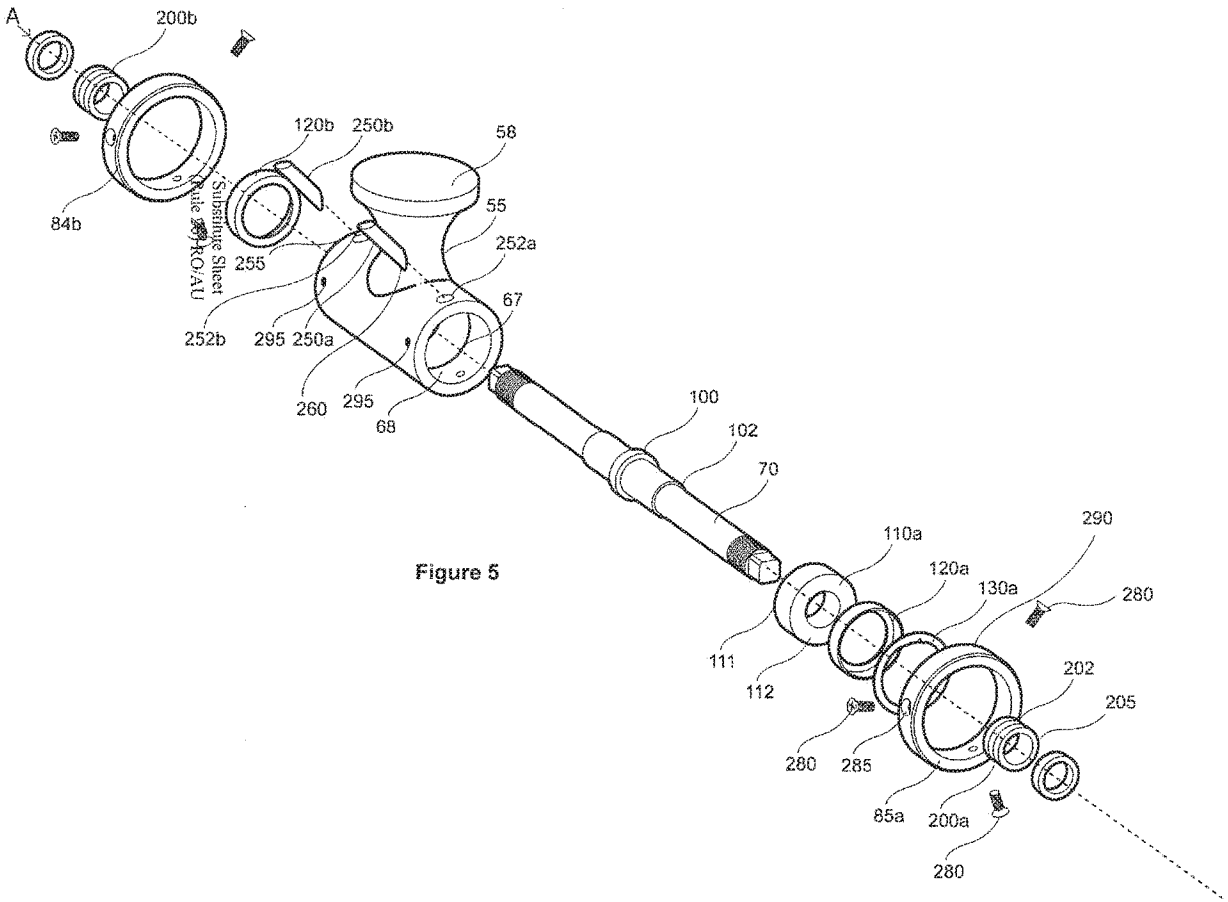
FIG. 5 is an exploded view of the truck assembly of the present invention.
Figure 6:
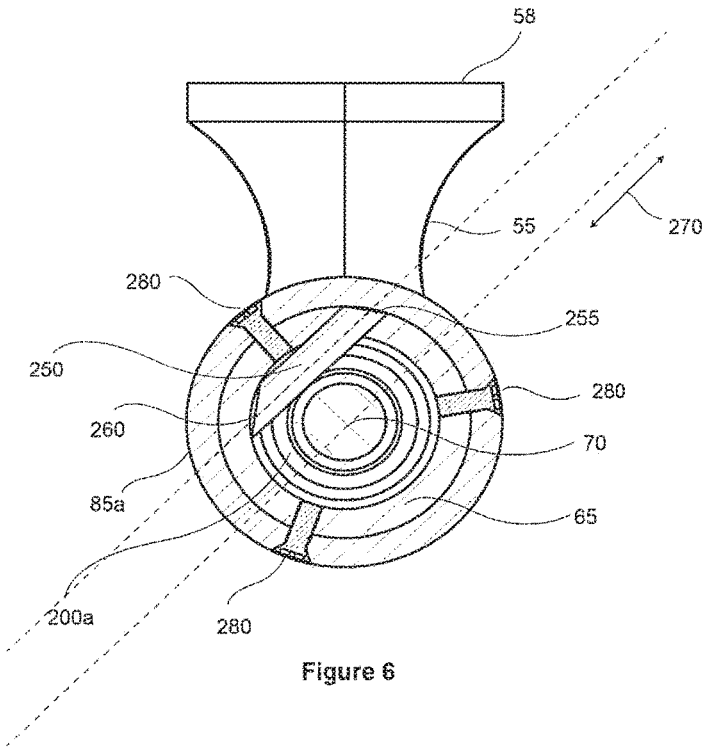
FIG. 6 is a side sectional view through A-A in FIG. 3.
Figure 7:
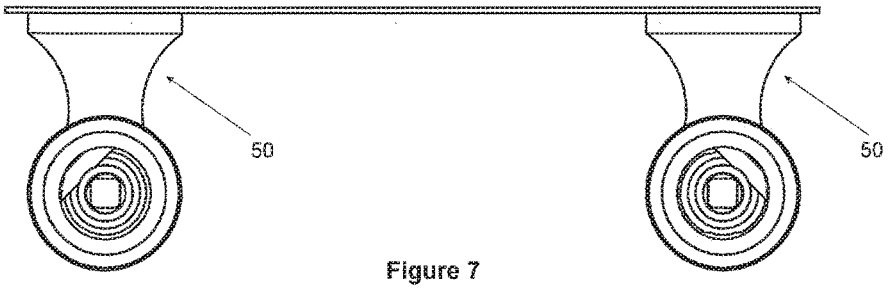
FIG. 7 is a side view of the present invention attached to a platform, ground engaging wheels excluded for clarity.

The truck assembly (50), as shown in FIGS. 2-7 has a base portion (55) having an upper mounting surface (58) for attachment to the underside of a skateboard or roller skate (not shown). The other mounting surface (58) can be attached in any manner known to those skilled in the art.

The base portion (55) also has an axle housing (65) being of substantially cylindrical shape, an axle (70) having threaded ends (75) to receive a threaded nut (not shown) so as to facilitate the attachment of a standard wheel as readily used in this area. Other means of attaching ground engaging wheels to the axle (70) are considered to fall within the scope of the invention. A pin (80) is inserted through the axle housing (65) and held in place by a lock ring (85). Bearing race (90) is firmly affixed to the axle (70), the pin (80)

abutting with the bearing race (90) to allow for slidable engagement of the pin (80) to the bearing race or groove (90).

The axle (70) having the threaded ends (75) (axle studs) includes a centerline flange (100) located approximately midway between the ends (76*a*) and (76*b*), onto which wheels are to be attached to, of the axle (70). Polymer or elastomer bushings (110*a* and 110*b*), which may be shrouded bushings, are inserted over the axle (70) and pushed snugly to abut the centerline flange (100) on the axle (70). The outer diameter of the bushings (110*a* and 110*b*) is sufficient to fit within the inner diameter of the opening (115) of the axle housing (65). When the axle (70) and bushings (110*a* and 110*b*) are inserted into the axle housing (65) stand off washers (120*a* and 120*b*) are inserted over the axle (70) and forced against the exposed surface (112) of the bushing (110). Holding the stand off washers (120) in place are snap washers (130*a* and 130*b*) which when in place snaps in to the groove (67) located at least partially around the inner surface (68) of the axle housing (65). When shrouded bushings are used in place of the bushings (110*a* and 110*b*), the stand off washers (120) are not required and the snap washers (130*a* and 130*b*) may either still be used or alternatively the shrouded bushings are held in place by an interference fit with the interior surface of the axle housing (65). The groove (67) is set back from the edge (117) of the axle housing (65) a pre-determined distance, the actual location of the groove (67) may differ according to construction and depending upon the type or width of bushings (110) that are utilised.

Bearing races, retaining rings, (200*a* and 200*b*) are press fitted or clearance fitted over the axle (70) and moved to urge up against the outer flange (102) of the axle (70), which sets them in place. The bearing race (200) has a groove (202) about its outer periphery surface (205). When the bearing race (200) is in place in the axle housing (65) a pin (250) is then inserted through the holes (252*a* and 252*b*) on the outer periphery of the axle housing (65).

The locking pin (250) is substantially cylindrical in shape having a first end (255) and a second end (260). The first end (255) is shaped so that it is at least substantially flush with the outer periphery of the axle housing when fully inserted into the hole (252) of the axle housing (65). The second end (260) of the pin (250) may also be shaped such that it substantially matches the profile of the inner surface (68) of the axle housing (65) for a flush fit. The pin (250) then rests within the groove (202) of the bearing race (200) that is fitted to the axle (70) further holding the axle (70) in place in the axle housing (65) but still allowing movement of the axle (70) in a substantially parallel angle to the angle of the locking pin (250) as indicated by arrow (270). The groove may extend fully or partially around the outer peripheral surface of the bearing race (200). In an alternative embodiment, the groove can be machined directly onto the axle surface thus removing the need for a bearing race. Although the term bearing race is used, no ball bearings are Once the pins (250) are in place in the axle housing (65) lock ring (85) is then inserted over the outer surface of the axle housing (65) and retaining screws (280) are then inserted into the openings (285) about the outer surface (290) of the lock ring (85) so as to threadably engage with the screw holes (295) on the axle housing (65). The lock ring (85) then prevents the removal of the pins (250) from within the hole or opening (252) of the axle housing securing the pins in place.

In order to change the steering characteristics of the truck assembly (50), a user can make various changes such as, for example, replacing the pins (250) with pins having a different shape or indeed different hardness characteristics to allow greater or less movement of the axle (70). In addition, the bushings (110) may also be changed to bushings having harder or softer materials, even to the point of having a bushing on one side of the axle with a different hardness characteristic in relation to the bushing on the other side of the axle. If the first bushing and second bushing are of the same material and have the same physical shape and characteristics then the movement of the axle (70) will be substantially consistent on both sides. By altering the first and second bushings it is then possible for the user to provide a firmer or softer ride on one side of the truck assembly compared to the other side.

Moreover, the construction of the truck assembly (50) is greatly simplified compared to that of prior art truck assemblies and allows for a substantial reduction in overall weight by omitting several of the key components required in the prior art truck assemblies, for example, such as the use of a king pin and related elements. This new simplified truck assembly thus provides overall a lighter truck assembly with improved steering characteristics.

The invention claimed is:

1. A truck assembly comprising: a base portion configured to be secured to an underside of a roller skate or skate board; an axle housing for receiving an axle; an axle: at least first and second pins; and at least one bushing supporting the axle, wherein the axle is housed within the axle housing and the at least one bushing, and wherein the axle is captively held within the axle housing, and wherein the at least first and second pins are in sliding engagement with the axle.

2. The truck assembly of claim 1, wherein the at least first and second pins pass through at least first and second openings in an outer surface of the axle housing and abut against the axle.

3. The truck assembly of claim 2, wherein the base portion is adapted to be releasably secured to an underside of a roller skate or skateboard.

4. The truck assembly of claim 1, wherein the at least first and second pins are held in place in the axle housing by first and second retaining rings.

5. The truck assembly of claim 4, wherein the first and second retaining rings are distal to one another on the axle housing.

6. The truck assembly of claim 4, wherein the first and second retaining rings are held in place on the axle housing by a plurality of retainers.

7. The truck assembly of claim 4, wherein the first and second retaining rings have a groove about an outer periphery.

8. The truck assembly of claim 7, wherein the groove is shaped to receive at least a portion of at least one of the at least first and second pins.

9. The truck assembly of claim 1, wherein the at least one bushing includes at least a first bushing and a second bushing located within the axle housing.

10. The truck assembly of claim 9, wherein the first bushing and the second bushing support the axle within the axle housing.

11. The truck assembly of claim 1, wherein the at least one bushing is a shrouded bushing.

* * * * *